United States Patent [19]

Reynolds

[11] Patent Number: 4,778,591

[45] Date of Patent: Oct. 18, 1988

[54] DEMETALATION OF HYDROCARBONACEOUS FEEDSTOCKS USING CARBONIC ACID AND SALTS THEREOF

[75] Inventor: John G. Reynolds, El Cerrito, Calif.

[73] Assignee: Chevron Research Company, San Francisco, Calif.

[21] Appl. No.: 901,342

[22] Filed: Aug. 28, 1986

[51] Int. Cl.[4] ..... C10G 17/00

[52] U.S. Cl. ..... 208/252; 208/251 R; 208/309; 208/240; 423/155; 423/165; 585/866

[58] Field of Search ..... 208/251 R, 252, 309, 208/240; 423/155, 165; 585/866

[56] References Cited

U.S. PATENT DOCUMENTS

| | | | |
|---|---|---|---|
| 2,744,853 | 5/1956 | Kavanaugh et al. | 208/252 |
| 2,767,123 | 10/1956 | Kickok et al. | 208/252 |
| 3,052,627 | 9/1962 | Lerner | 208/240 |
| 3,167,500 | 1/1965 | Payne | 208/251 R |
| 3,377,268 | 4/1968 | Li et al. | 208/251 R |
| 3,413,307 | 11/1968 | Heimlich | 208/240 |
| 3,449,243 | 6/1969 | Strong, Jr. et al. | 208/251 R |
| 4,228,002 | 10/1980 | Vaidyanathan et al. | 208/251 R |
| 4,432,865 | 2/1984 | Norman | 208/252 |
| 4,439,345 | 3/1984 | Duke | 252/8.55 D |
| 4,465,589 | 8/1984 | Kukes et al. | 208/252 |
| 4,491,515 | 1/1985 | Agnew et al. | 208/181 |
| 4,518,489 | 5/1985 | Hitzman | 208/223 |
| 4,525,269 | 6/1985 | Ikematsu et al. | 208/309 |
| 4,576,707 | 3/1986 | Siskin et al. | 208/430 |
| 4,587,005 | 5/1986 | Siskin et al. | 208/435 |

FOREIGN PATENT DOCUMENTS

| | | | |
|---|---|---|---|
| 3300413 | 7/1983 | Fed. Rep. of Germany | 208/309 |

*Primary Examiner*—Asok Pal
*Assistant Examiner*—Helane Myers
*Attorney, Agent, or Firm*—S. R. La Paglia; T. G. DeJonghe; Q. T. Dickinson

[57] ABSTRACT

A process is disclosed for removing metals contaminants, particularly calcium compounds, from hydrocarbonaceous feedstocks using aqueous carbonic acids, its salts, or mixtures thereof as the metals extraction agent. The hydrocarbonaceous layer and aqueous layers are then separated and the demetalated hydrocarbonaceous feedstock is removed for further processing.

15 Claims, No Drawings

DEMETALATION OF HYDROCARBONACEOUS FEEDSTOCKS USING CARBONIC ACID AND SALTS THEREOF

BACKGROUND OF THE INVENTION

This invention relates to a process for the removal of calcium from calcium-containing petroleum crudes, heavy hydrocarbonaceous residua or solvent deasphalted oils derived from crudes and residua using carbonic acid as an extraction agent. A few, but increasingly important, petroleum crude feedstocks and residua contain levels of calcium which render them difficult, if not impossible, to process using conventional refining techniques. Specifically, the calcium contaminants causing particular problems are in the form of nonporphyrin, organometallically-bound compounds. These species have been only recently discovered in crude oils, very heavy crude oils in particular, and are apparently relatively rare. One possible class of calcium-containing compounds identified in particular is the calcium naphthenates and their homologous series. These organo-calcium compounds are not separated from the feedstock by normal desalting processes. The particular problem caused by them in a conventional refining technique is the very rapid deactivation of hydroprocessing catalysts. Examples of feedstocks demonstrating objectionably high levels of calcium compounds are those from the San Joaquin Valley in California. Generally, these crudes are contained in a pipeline mixture referred to as San Joaquin Valley crude or residuum.

The problems presented by calcium in petroleum feedstocks and their necessity for removal have only been recently appreciated, and the prior art contains few references specifically to its removal. Metals removal generally using organic compounds, however, has been addressed in the prior art, specifically for the removal of known metallic contaminants, such as nickel, vanadium, and/or copper, which are also ordinarily found in feedstocks as porphyrins, and other organometallic compounds.

In U.S. Pat. No. 3,052,627, Lerner, metals-contaminants are removed from crude petroleum feedstocks using a 2-pyrrolidone-alcohol mixture. In U.S. Pat. No. 3,167,500, Payne, metallic contaminants, such as metal-containing porphyrins, are removed from petroleum oils using a condensed polynuclear aromatic compound having a preferred C/H ratio and a molecular weight ordinarily called pitch binders. In U.S. Pat. No. 3,153,623, Eldib et al, selected commercially available organic compounds of high dielectric strength were added to assist in the electrically directed precipitation removing metals with the polar organic molecules.

It has now been unexpectedly found that the calcium-containing contaminants may be effectively removed from the feedstocks of the present invention by binding the calcium compounds using carbonic acid and its salts.

SUMMARY OF THE INVENTION

The process comprises a method for demetalating hydrocarbonaceous feedstocks, particularly crude petroleum or residua using an aqueous solution of an extraction agent. The method is particularly appropriate for removing calcium, especially non-porphyrin, organically-bound calcium compounds. The preferred metal extraction agent is carbonic acid and its salts, such as ammonium carbonate, in an aqueous solution. In the preferred process, the feedstock to be demetallized is intimately and thoroughly mixed with an aqueous solution of carbonic acid, its salts or a mixture thereof. The metals form compounds with the agent and are removed in the aqueous phase. The aqueous phase and the hydrocarbon phase are separated and the hydrocarbonaceous feedstock is then available for hydroprocessing.

DETAILED DESCRIPTION OF THE INVENTION

Various petroleum crude feedstocks, and residua produced from them, contain unacceptably high levels of calcium-containing contaminants. These calcium ions, especially organically-bound calcium-containing compounds, cause distinct processing difficulties in standard hydroprocessing techniques, ordinarily by the rapid deactivation or fouling of the hydroprocessing catalyst. This invention comprises a method for removing those calcium-containing contaminants prior to hydroprocessing of the crude or residua by using a known chemical agent, known as carbonic acid and its salts.

The invention can be applied to any hydrocarbonaceous feedstock containing an unacceptably high level of calcium. Those feedstocks can include crude petroleum, especially from particular sources, such as San Joaquin Valley crude, including, for example, South Belridge, Kern Front, Cymric Heavy, Midway Sunset, or mixtures thereof. Additionally, atmospheric or vacuum residua or solvent deasphalted oils derived from these crudes or residua, which are being increasingly hydroprocessed into more usable products such as gas oils, gasoline, diesel fuel, etc., also have unacceptably high calcium levels. It is within the contemplation of the invention that any other hydrocarbonaceous feedstocks, such as shale oil, liquefied coal, beneficiated tar sand, etc., which may contain calcium contaminants may be processed using this invention.

The basic process is relatively simple: The crude or residuum desired to be processed is mixed with an aqueous solution of carbonic acid or a salt thereof, and a base or acid for adjusting the pH above 2, and preferably between 5 to 9. The calcium complex formed is removed into the aqueous phase of the mixture. The two phases, the aqueous and the crude or hydrocarbonaceous phase, are separated or permitted to separate, and the aqueous solution is removed. This results in a calcium-free hydrocarbon feed which then can be handled in the same manner as any other carbonaceous feed and processed by conventional hydroprocessing techniques.

It is contemplated that the physical separation process is ordinarily to be done in a conventional crude oil desalter, which is usually used for desalting petroleum crudes prior to hydroprocessing. The separation may be done by any separation process, however, and may include countercurrent extraction.

It is well known that carbonic acid anions have a high affinity for calcium and other metal ions. Carbonic acid, and therefore the carbonate ion, may be generated in high concentrations in aqueous solutions by the exposure of a basic solution to high pressures of carbon dioxide.

Solutions of carbonic acid are more commonly made, however, by the dissolution in water of a carbonic acid salt. A common example of these salts is ammonium carbonate, $(NH_4)_2CO_3$; molecular weight 114.10; which is also known by the name Hartshorn.

The ammonium salt forms of carbonic acid can be formed generally by the reaction of ammonium bicarbonate and carbamate solutions, and can be isolated in some cases from the aqueous solution as a crystalline salt. The salts are generally more water soluble, less acidic, and more convenient to use than the free acid. They contain a variable amount of water and have a general formula containing from 30–34% $NH_3$ and 45% $CO_2$.

Ammonium carbonate is commonly used in cleaning solutions and in the washing and defatting of wool. It is also used in the food and beverage industry as a baking agent and preservative. It is also a member of a broad class of ligands which complex or coordinate metal ions. These compounds form very stable metal ligand complexes, and ammonium carbonate itself forms a complex with the $Ca^{+2}$ ion which can be isolated.

Carbonic acid and its salts will also react with other metal ions in aqueous solution, but appears to have little or no effect on the more commonly found, ordinary organometallic metal contaminants in petroleum, such as nickel and vanadium petroporphyrins. It may, however, have some effect on iron, and carbonic acid and its salts may be effective for removing organo-iron compounds.

As discussed previously, in order for the calcium to bind appropriately to the carbonic acid, the pH should be above 2, and preferably 5 to 9. One difficulty with the addition of base, however, is the formation of emulsions which can interfere with separation. Therefore, the most preferred pH is 6, especially when using naphthenic acid crudes.

The temperature at which the extraction takes place is also a factor in process efficiency. The extraction may take place at ambient or room temperature, around 20° C., but the mole equivalents of carbonic acid must then be limited to 300 or above to achieve high calcium removal. If the extraction takes place at elevated temperatures, the mole equivalents may be reduced to 4.5 or above. A preferred elevated temperature is 180° F. and above.

For preferred separation, the ratio of aqueous carbonic acid solution to hydrocarbonaceous feed should be optimized, with the determining factor being the separation method. Commercial desalters, for example, ordinarily run at 10% or less aqueous volume. Countercurrent extraction may also be used for separation, and effective separations have been done at 50% or more aqueous volume. The contact time between the aqueous extraction solution and the hydrocarbonaceous feed may vary from between a few seconds to about 4 hours. The preferred contact time is from about 4 to about 60 seconds.

Other carbonic acid-related substances which may be used in place of ammonium carbonate include: sodium carbonate, soda ash, and natural occurring carbonate-containing ores, such as thermonatrite, natrite, natron, and nevite.

EXAMPLES

In laboratory trials, the results of which are detailed in the tables below, the amount of San Joaquin Valley vacuum residuum (93 ppm Ca) was dissolved in toluene to give a workable viscosity, and was mixed with the indicated amount of carbonic acid solution. The solution was prepared by dissolving the indicated amount of ammonium carbonate in deionized $H_2O$ to give the listed mole amount of ammonium carbonate to calcium mole ratio, and the pH was adjusted with ammonium hydroxide or strong mineral acid. A demulsifier, trade named treatolite L-1562, was added to control emulsion formation. The carbonic acid solution and the oil mixture was shaken and allowed to separate, preferably overnight. The residuum was analyzed before and after treatment to determine the amount of calcium removed.

EXAMPLE 1

To demonstrate carbonic acid as an effective calcium removal agent, comparative tests were performed on the vacuum residuum of San Joaquin Valley at room temperature. Table I indicates that a good portion of the calcium is removed by relatively low amounts of carbonic acid (as ammonium carbonate) mole equivalents. In the extractions performed with refinery desalter water, acids, and bases, the percent of calcium removal was low.

EXAMPLE 2

Laboratory trials were performed at elevated temperature to optimize the amount of carbonic acid (as ammonium carbonate) used in extraction of the calcium. Table II shows the activity of the carbonic acid begins to decrease around 5 mole equivalents, and drastically decreases around 4.0 equivalents.

EXAMPLE 3

For comparison, Table III lists calcium removal by conventional desalting solutions. Calcium removal is low compared to carbonic acid (as ammonium carbonate).

TABLE I

Ca Removal From San Joaquin Valley Vacuum Residuum by Ammonium Carbonate at Room Temperature

| Equivalents | pH | % Ca Removal |
|---|---|---|
| 295 | natural | 82.2 |
| 300 | 9.3 | 77.4 |
| 15 | 9.3 | 43.6 |

50% Aqueous Volume, Feed has 93 ppm Ca.

TABLE II

Calcium Removal From San Joaquin Valley Vacuum Residuum by Ammonium Carbonate at 180° F.

| Mole Agent Mole Ca | Reaction Time, Min. | Lb Agent Bbl Residuum | % Ca Removal |
|---|---|---|---|
| 78.0 | 10 | 7.30 | 96 |
| 37.5 | 15 | 3.51 | 91 |
| 15.0 | 15 | 1.41 | 96 |
| 7.5 | 15 | 0.70 | 97 |
| 4.5 | 15 | 0.42 | 87 |
| 1.6 | 15 | 0.15 | 53 |

pH6, 50% Aqueous Volume, Feed has 93 ppm Ca

TABLE III

Ca Removal From San Joaquin Valley Vacuum Residuum by Standard Desalting Agents

| Mole Agent | Mole Agent Mole Ca | Aqueous Volume, % | % Ca Removal |
|---|---|---|---|
| Hydrochloric Acid | 6,650 | 66 | 7.2 |
| Ammonium Hydroxide | large excess | 66 | 9.2 |
| Water | 200,000 | 16 | 0.2 |

What is claimed is:

1. A method for demetallizing hydrocarbonaceous feedstock wherein said metals consist essentially of Group IIA metals, said method comprising:

mixing said hydrocarbonaceous feedstock with an aqueous solution of a metals extraction agent, said metals extraction agent comprising carbonic acid, its salts, or mixtures thereof; and separating the substantially demetalated hydrocarbonaceous feedstock from the aqueous solution.

2. The method as claimed in claim 1 wherein the metal is calcium.

3. The method as claimed in claim 1 wherein the metals are organometallically-bound, non-porphyrin compounds.

4. The method as claimed in claim 3 wherein the compounds are compounds of calcium.

5. The method as claimed in claim 1, or 3 wherein said metals extraction agent is selected from the group consisting of ammonium carbonate, sodium carbonate, soda ash, thermonatrite, natrite, natron, and nevite.

6. The method as claimed in claim 5 wherein the said metals extraction agent comprises ammonium carbonate.

7. The method as claimed in claim 5 wherein the pH of the mixing step is adjusted to 2 or above.

8. The method as claimed in claim 5 wherein the pH of the mixing step is adjusted to 5 or above.

9. The method as claimed in claim 8 wherein the temperature is ambient.

10. The method as claimed in claim 9 wherein the mole equivalents ratio of carbonic acid to metals is 15 or above.

11. The method as claimed in claim 1 wherein the temperature is elevated.

12. The method as claimed in claim 8 wherein the temperature is about 180° F. and above.

13. The method as claimed in claim 12 wherein the mole equivalents of carbonic acid, as ammonium carbonate, to metals is about 4.5 or above.

14. The method as claimed in claim 1 where said separating is performed by conventional desalting or countercurrent extraction.

15. The method as claimed in claim 1 wherein the hydrocarbonaceous feedstock is selected from the group consisting of:

crude petroleum, atmospheric or vacuum residua solvent deasphalted oil derived from these crudes and residua, shale oil, liquefied coal, and tar sand effluent.

* * * * *